US005328386A

United States Patent [19]

Frantz et al.

[11] Patent Number: 5,328,386

[45] Date of Patent: Jul. 12, 1994

[54] WIRE ORGANIZER FOR BALLAST CONNECTOR

[76] Inventors: Robert H. Frantz, R.D. 1, Box 1182, Newville, Pa. 17241; Michael A. McCaffrey, 108 Nagle St., Harrisburg, Pa. 17104

[21] Appl. No.: 73,856

[22] Filed: Jun. 8, 1993

[51] Int. Cl.[5] ..... H01R 13/58

[52] U.S. Cl. ..... 439/465

[58] Field of Search ..... 439/389, 391, 399, 400, 439/426, 436, 443, 465, 467, 562

[56] References Cited

U.S. PATENT DOCUMENTS

| | | | |
|---|---|---|---|
| 4,139,727 | 2/1979 | Kuballa | 439/426 X |
| 4,225,205 | 9/1980 | Sinclair et al. | 439/467 |
| 4,413,872 | 11/1983 | Rudy et al. | 439/467 |
| 4,538,874 | 9/1985 | Dambach et al. | 439/426 X |
| 4,729,740 | 3/1988 | Crowe et al. | 439/76 |
| 5,260,678 | 11/1993 | Van Wagener et al. | 439/562 X |

*Primary Examiner*—Eugene F. Desmond
*Attorney, Agent, or Firm*—Bruce J. Wolstoncroft

[57] ABSTRACT

A wire organizer for bundling discrete insulated wires in a cable configuration for mass insertion into an electrical ballast connector. The wire organizer includes a lower housing assembly (20) having a wire yoke (26) mounted across the bottom wall, the yoke (26) being formed with an array of notches (27) spaced thereacross each for seating a corresponding discrete wire (10). A pair of flanking teeth (29) are provided in each notch (27) for gripping the insulated section (14) of the wire inserted therein. An upper housing assembly (40) mates with the lower housing assembly (20) to cover the wire yoke (26), thereby capturing the plurality of discrete wires (10) in their respective notches (27). A similar second wire yoke (30) may be provided for supplemental seating of the wires (10) along their insulated sections (14). The wire organizer facilitates mass insertion of the wires (10) into the mating ballast connector (60), and it shrouds, protects, and provides strain relief to the wire terminations in the ballast connector (60). Since the wires (10) are terminated only once in the ballast connector, the need for terminal contacts in the wire organizer is eliminated and the cost is significantly reduced.

16 Claims, 4 Drawing Sheets

WIRE ORGANIZER FOR BALLAST CONNECTOR

FIELD OF THE INVENTION

The present invention relates to electrical ballasts for fluorescent lighting and, in particular, to a wire organizer for bundling discrete wires to allow mass insertion or extraction to/from a ballast connector.

BACKGROUND OF THE INVENTION

A fluorescent electrical ballast is a long rectangular metal box or "can" which encloses the electrical components of a fluorescent light fixture. Electrical ballasts are typically mounted inside or directly behind the fixture. The ballast is generally filled with a sealer or "potting compound" which hardens around the electrical components to seal them inside.

To accomplish connection of the internal electrical components to external power and control lines, several discrete wires typically exit the ballast through the potting compound. During installation, the discrete wires are individually stripped and twisted together with corresponding external wires. A threaded protective cap is then screwed over each twisted pair to make the connection permanent. The conventional process is very labor intensive and costly. Moreover, it is oftentimes unsafe. The installer must climb to the height of the light fixture and make the necessary connections while maintaining his or her balance. In cases of repair, at least some of the wires are typically activated, or "hot." It is quite difficult to avoid the hot wires while stripping and connecting other wires, and severe electrical shocks may result.

Certain manufacturers have begun selling ballasts in which the discrete wires are already terminated in a connector. The above-described problems are largely avoided. However, the external wires must likewise be terminated in a mating connector. The mating connector also carries an array of conductive terminals to terminate the corresponding external wires, and such terminal connectors are quite costly.

U.S. Pat. No. 4,729,740 provides a partial solution in the form of an electrical ballast with integral ballast connector that mounts directly on the printed circuit board and faces outwardly from the ballast. The ballast connector receives and secures multiple discrete external wires in corresponding press-fit sockets. This eliminates the discrete wires which otherwise protrude from the ballast, and it requires no mating connector for the external wires. Unfortunately, it is still a burdensome task to organize and insert (or extract) the external wires one-by-one into (or from) the ballast connector.

It would be greatly advantageous to completely eliminate the need for individual handling of the wires during installation or repair of an electrical ballast without resorting to a full-blown mating terminal connector for the external wires.

SUMMARY OF THE INVENTION

It is, therefore, an object of the present invention to provide a simple and inexpensive wire organizer device for bundling discrete wires in cable form for mass insertion into a ballast connector of the type set forth in U.S. Pat. No. 4,729,740.

It is another object to provide a device as described above which may be keyed to the ballast connector to facilitate mass insertion of the external wires therein.

It is still another object to provide a device which shrouds, protects, and provides strain relief to the wire connections at an electrical ballast connector.

In accordance with the above-described and other objects, the present invention provides a wire organizer for bundling discrete insulated wires in a cable configuration for mass insertion into a ballast connector. The wire organizer includes a lower housing assembly having a lower shell section formed with a bottom wall and two side walls, and a wire yoke mounted across the bottom wall of the lower shell section. The wire yoke is formed with an array of notches spaced thereacross each for seating a corresponding discrete wire. A pair of flanking teeth are provided in each notch for gripping the conductive tip of the wire inserted therein. In addition, the wire organizer includes an upper housing assembly that mates with the lower housing assembly to cover the wire yoke, thereby capturing the plurality of discrete wires in their respective notches.

A second wire yoke may be arranged parallel behind the above-described wire yoke for supplemental seating of the wires along their insulated sections. The second wire yoke is likewise formed with an array of notches spaced thereacross, and a pair of flanking teeth protruding into each notch for gripping the insulation of a wire on opposing sides.

The upper housing assembly can be similar to the lower housing assembly in that it too may be formed with wire yokes corresponding to those of the lower housing assembly. When the upper housing assembly is fitted over the lower housing assembly, the corresponding pairs of wire yokes come together such that the opposing notches form collars to encircle and confine each discrete wire seated therein.

The wire organizer of the present invention is preferably keyed to the mating ballast connector to facilitate mass insertion, and releasable locking means may be provided to allow the wire organizer to be secured against the ballast connector.

Other advantages and results of the invention are apparent from a following detailed description by way of example of the invention and from the accompanying drawings.

DETAILED DESCRIPTION OF THE INVENTION

Figure 1:
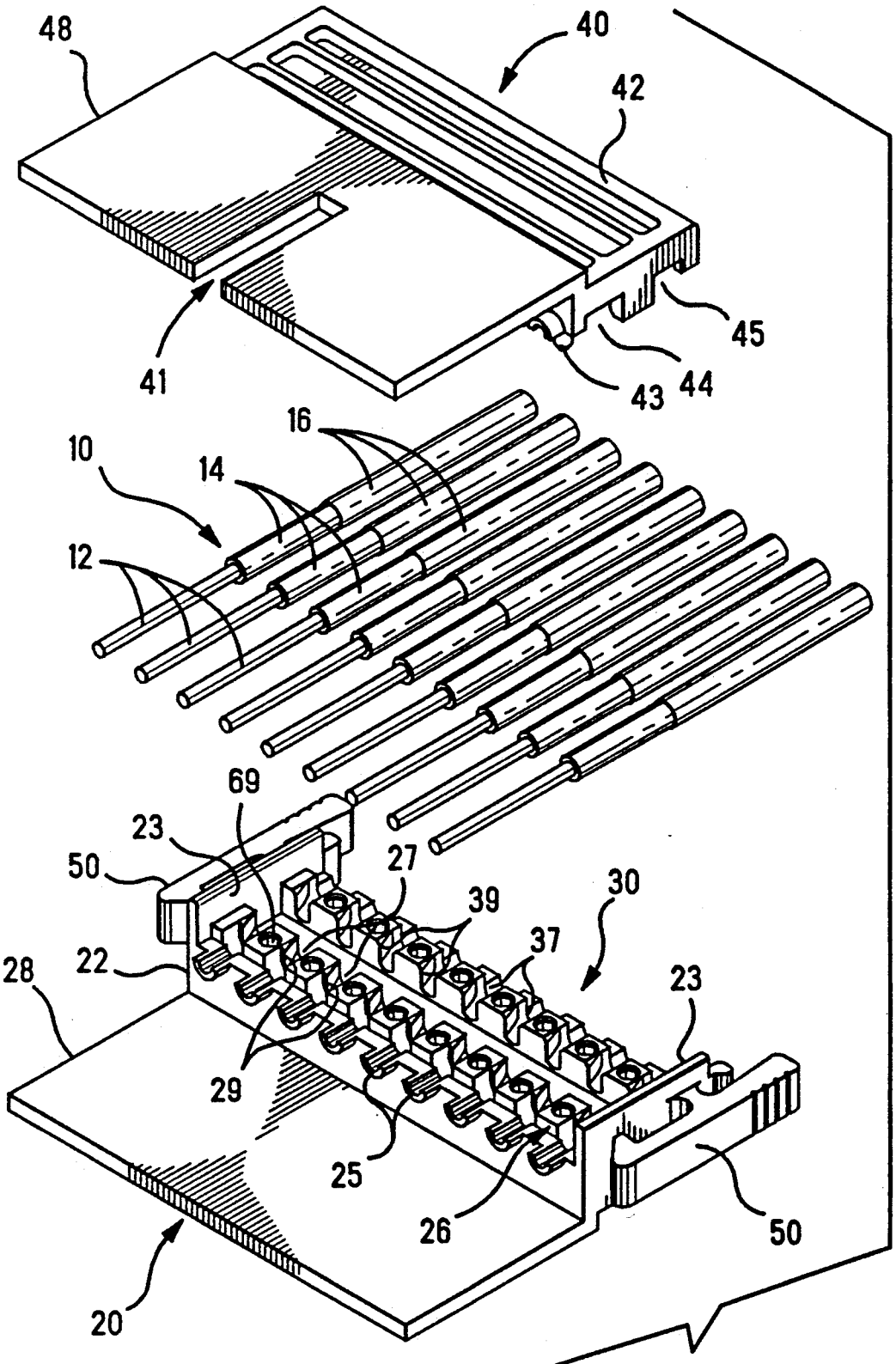
FIG. 1 is an exploded perspective view of a wire organizer according to the present invention.

With more particular reference to the drawings, FIG. 1 is an exploded assembly diagram of a wire organizer according to the present invention.

The wire organizer of FIG. 1 is designed to mate with an integral ballast connector of the type that terminates discrete wires such as set forth in U.S. Pat. No. 4,729,740 issued to Crowe et al. on Mar. 8, 1988.

The illustrated wire organizer is designed to bundle a plurality of discrete insulated wires 10 in a cable configuration for mass insertion in the ballast connector. However, it should be understood that the wire organizer of the present invention may be adapted to facilitate mass insertion of discrete wires in virtually any type receptacle or connector which receives such wires.

In the case of a typical fluorescent lighting ballast, the wires to be terminated include a central conductor 12 which is encased in an insulating sheath or section 14, which is in turn coated in a protective outer layer 16.

The wire organizer of the present invention includes a lower housing assembly 20 which includes a lower shell section formed with two opposing side walls 23 and a spanning bottom wall 22. The bottom wall 22 supports a first wire yoke 26 which likewise spans the two side walls 23. The first wire yoke 26 is provided with an array of notches 27 spaced evenly thereacross for seating corresponding wires 10. The notches 27 of the first wire yoke 26 are designed to capture the wires 10 by their insulating sections 14. This is preferably accomplished with a plurality of teeth or protrusions 29. In the illustrated embodiment, a pair of protrusions 29 is provided within each notch 27. The protrusions 29 protrude outwardly from both sides of the notches 27 and are forwardly inclined in order to bite into the insulating sections 14 of wires 10. This way, protrusions 29 prevent rearward extraction of the wires 10 and afford a good amount of strain relief.

In the illustrated embodiment, a second wire yoke 30 is also provided to give further support and strain relief to wires 10. The second wire yoke 30 likewise includes an array of notches 37 spaced evenly between the side walls 23 of the lower shell section 20. The notches 37 are each sized to seat a corresponding wire 10 along its insulating section 14. The notches 37 are constricted along their length to compress the insulation of wires 10 therein. For instance, in the illustrated embodiment a tooth or protrusion 39 is provided on both sides of each notch 37 to compress the insulated section 14 of wire 10 therebetween. When wires 10 are inserted in the notches 27, the protrusions 39 capture each wire 10 by its insulating section 14 to prevent rearward extraction. This affords an additional level of strain relief. The combined strain relief of the second wire yoke 30 and the first wire yoke 26 effectively prevents rearward slip during mass insertion of the wires 10, and once inserted it protects the wire terminations in the ballast connector against stresses and strains to the wires 10.

A plurality of semi-cylindrical supports 25 is provided at the front of the first wire yoke 26, each wire support 25 protruding forwardly before a corresponding notch 27 to support the protruding tips of wires 10.

An upper housing assembly 40 is also provided, and this fits over the lower housing assembly 20 to enclose the wires 10 and capture them within the corresponding notches 27 and 37. In the illustrated embodiment, the upper housing assembly 40 conforms to the bottom wall 22 of the lower housing assembly 20 and side walls are omitted. A top wall 42 is provided, and this fits across the two side walls 23 of the lower housing assembly 20 to form an enclosure for the wires 10. Preferably, the upper housing assembly 40 snap fits onto the lower housing assembly 20 by means of a compression fitting of sorts. For instance, the illustrated embodiment incorporates pylons 43 in the upper housing assembly 40 which fit into mating holes 69 in the opposing section. However, it should be noted that any other suitable fastening means may be provided to accomplish the same.

The internal configuration of the upper housing assembly 40 preferably corresponds to that of the lower housing assembly 20. Specifically, in the illustrated embodiment recesses 44 and 45 are provided to receive the first wire yoke 26 and second wire yoke 30, respectively.

To further protect the wire terminations occurring in the mating ballast connector, a shroud plate 28 protrudes forwardly from the bottom wall 22 of the lower housing assembly 20. Likewise, a shroud plate 48 protrudes forwardly from the upper wall 42 of the upper housing assembly 40. Shroud plates 48 and 28 substantially enclose the protruding tips 12 of the wires carried therein and protect them during and after the insertion process. The shroud plates 28 and 48 also provide protection for the installer. As the tips of the wires are substantially enclosed, the probability of the installer contacting the exposed tips is greatly reduced, thereby reducing the likelihood of the installer receiving an electrical shock.

The shroud plates 28 and 48 also offer a convenient means of keying the wire organizer to the mating ballast connector. For instance, in the illustrated embodiment the upper shroud plate 48 is formed with a central notch 41 extending inwardly from the foremost edge. A corresponding tab may be provided on the ballast connector for slidable insertion within notch 41. This serves to guide insertion of the wire organizer onto the ballast connector and the conductive tips 12 of wires 10 into the ballast connector contact terminals.

In addition, latching means may be provided on the wire organizer to releasably secure it to the mating ballast connector. In the illustrated embodiment, a particular latching means includes a pair of resilient latching fingers 50 mounted on the side walls 23 for gripping the mating 10 ballast connector.

Figure 2:
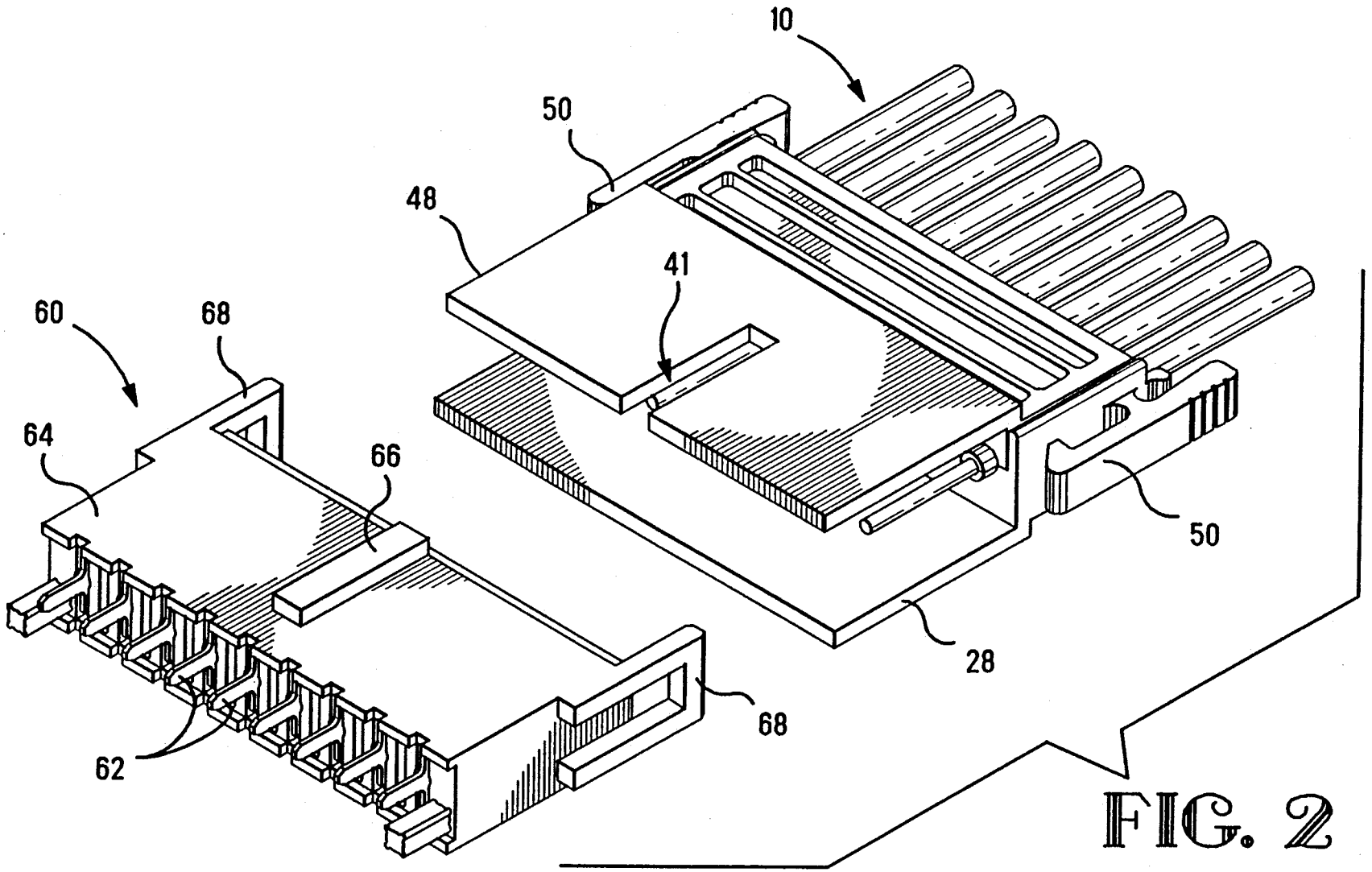
FIG. 2 is a perspective view of the assembled wire organizer of FIG. 1 aligned for mass insertion of wires 10 within a mating ballast connector 60.

FIG. 2 illustrates the assembled wire organizer of the present invention aligned for mass insertion of wires 10 within a mating ballast connector 60. As in conventional ballast connectors, a plurality of terminal contacts 62 is arranged within the ballast connector 60 for terminating the conductive tips 12 of each wire 10. The illustrated ballast connector is slightly modified to cooperate with the wire organizer. Specifically, a raised tab 66 is provided centrally on ballast connector housing 64 to fit within the notch 41 in the upper shroud plate 48. In addition, stirrups 68 are provided on opposing sides of the ballast connector housing 64 in order to catch the resilient latching fingers 50 mounted on the respective side walls 23 of the wire organizer.

Figure 3:
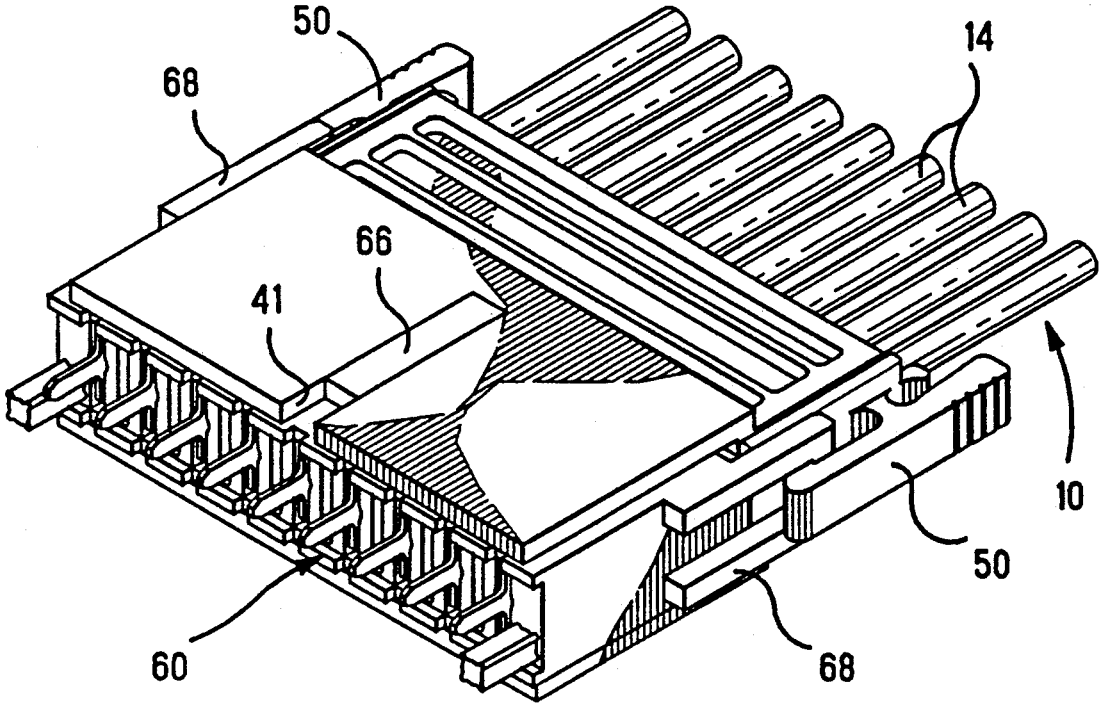
FIG. 3 is a perspective view of the assembled wire organizer of FIG. 1 secured to the mating ballast connector 60.

The wire organizer of the present invention is inserted into the mating ballast connector 60 to mass terminate the wires 10 as shown in FIG. 3. The raised section 66 on the ballast connector 60 slides into notch 41 to guide insertion. The resilient fingers 50 have latching tips which catch the ends of the stirrups 68 upon full insertion, thereby maintaining the connection.

Figure 4:
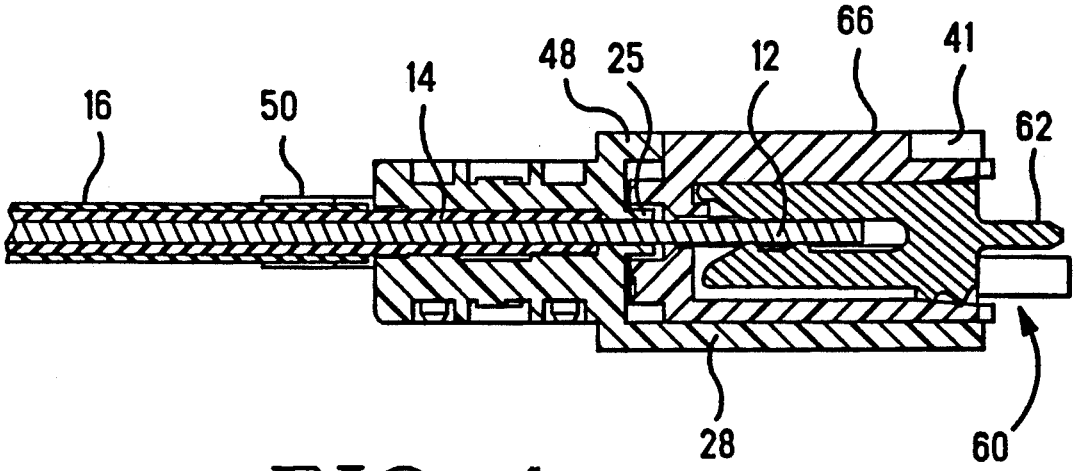
FIG. 4 is a cross-section of the assembled wire organizer secured to the mating ballast connector 60 as in FIG. 3.

FIG. 4 illustrates a cross-section of the wire organizer connected to the ballast connector as in FIG. 3 of the present invention as it is used to terminate multiple wires 10 in a ballast connector 60. Shroud plates 28 and 48 of the wire organizer fit over and protect the ballast connector 60. The protruding tips 12 of wires 10 are guided by the shroud plates 28 and 48, notch 41 and tab 66 into a corresponding terminal contact 62 seated in the ballast connector 60. The structure of the wire organizer allows precision alignment of the conductive tips 12 of wires 10 with the corresponding terminals 62 in the ballast connector, and the wires 10 are fully supported to withstand the insertion forces.

Figure 5:
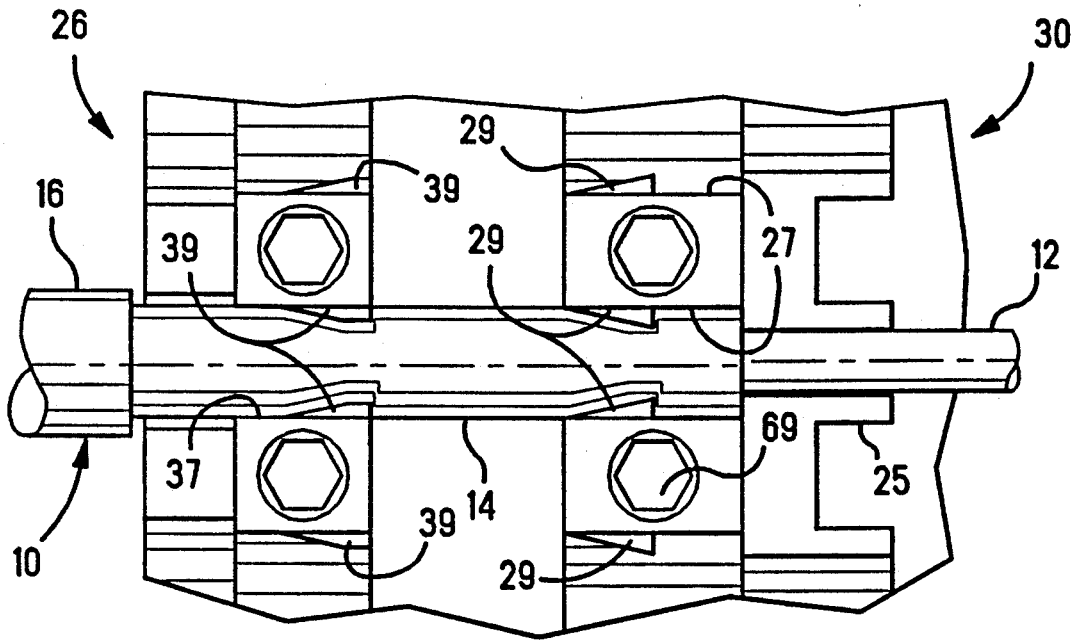
FIG. 5 is a detailed top view of one exemplary wire 10 carried in the first wire yoke 26 and second wire yoke 30.

FIG. 5 provides a detailed illustration of the manner by which one exemplary wire 10 is-supported by the first wire yoke 26 and second wire yoke 30. The protrusions 29 flanking the notches 27 of the first wire yoke grip the insulated sections 14 of wires 10. The length of conductive tip 12 protruding forwardly of the notch 27 is supported and aligned by the semi-cylindrical support 25. The second wire yoke 30 is spaced behind the first wire yoke 26 and grips the insulated portion 14 of the wire 10. The protrusions 29 and 39 dig into the insulated sections 14 of the wire to prevent the extraction of the wires from the respective yokes.

Figure 6:
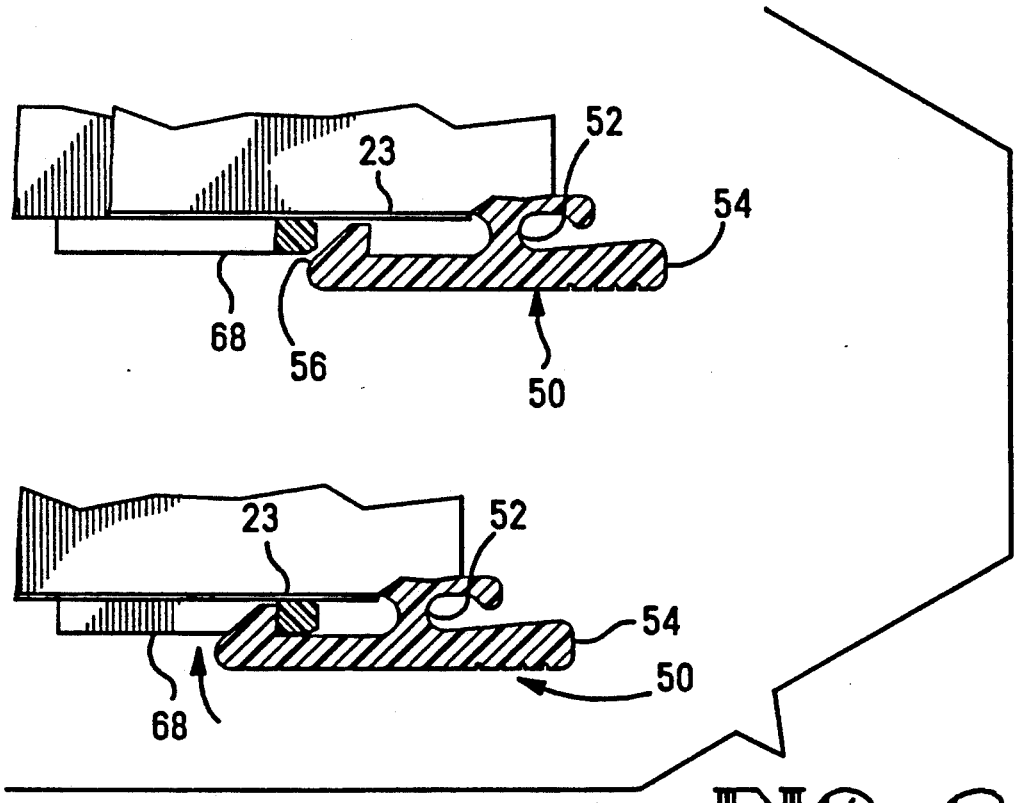
FIG. 6 is a sequential illustration of the operation of one exemplary latching finger 50 as shown in FIG. 1, the latching finger 50 being shown as a cross-section.

FIG. 6 illustrates the detailed configuration and preferred operation of one exemplary latching finger 50. The latching finger 50 is attached to the side wall 23 by a resilient central stem 52 which may be integrally molded thereto. Finger tab 54 extends rearwardly of the central stem 52 to allow manual pivoting of the resilient finger 50 about the central stem 52. The resilient finger 50 extends forwardly of the central stem 52 to a latching tip 56. As the wire organizer and wires 10 of the present invention are slidably inserted into the mating ballast connector 60 of FIG. 2, the latching tip 56 of the resilient finger 50 rides up over the stirrup 68. When the latching tab 56 clears the stirrup 68 (upon full insertion), resilient finger 50 snaps into a locked position thereby securing the wire organizer to the ballast connector 60.

The protection afforded by the shroud plates 28 and 48 together with the integrity of the mechanical connection afforded by the mating ballast connector 60 with the cooperating wire organizer of the present invention, and the strain relief afforded by the first wire yoke 26 and the second wire yoke 30 combines to achieve a highly reliable means for mass terminating a plurality of discrete insulated wires 10 in a ballast connector.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

We claim:

1. A wire organizer for bundling a plurality of discrete insulated wires in a cabled configuration for mass insertion in a discrete-wire-terminating connector, said wires being stripped to expose a length of conductor, the wire organizer comprising:

a lower housing assembly having a first wire yoke formed with an array of notches spaced thereacross each for seating a corresponding one of said wires, and a pair of flanking teeth protruding into said notch for gripping the conductor of said wire on opposing sides; and an upper housing assembly to mate with said lower housing assembly and cover said first wire support bracket, thereby capturing said plurality of wires in their respective notches.

2. The wire organizer according to claim 1 wherein said lower housing assembly further comprises a second wire yoke arranged parallel behind said first wire yoke, said second wire yoke likewise being formed with an array of notches spaced thereacross each aligned with a notch on said first wire yoke for supplemental seating of said wire, and a pair of flanking teeth protruding into said notch for gripping the insulation of said wire on opposing sides;

said upper housing assembly likewise covering said second wire support bracket, thereby capturing said plurality of wires in their respective notches.

3. The wire organizer according to claim 2 wherein said lower housing assembly further comprises a lower plate protruding forwardly of said first wire yoke, and said upper housing assembly further comprises an upper plate protruding forwardly therefrom, said upper and lower plates serving to shroud the wires protruding forwardly from said first wire yoke.

4. The wire organizer according to claim 1 wherein said first wire yoke arranges said wires with the stripped conductors protruding forwardly therefrom in a side-by-side array for mass insertion into a ballast connector.

5. The wire organizer according to claim 4 wherein at least one of said lower plate and upper plate are keyed to said ballast connector.

6. The wire organizer according to claim 4 further comprising a pair of latches mounted on opposing sides of one of said upper housing or lower housing for securing said wire organizer to said ballast connector.

7. The wire organizer according to claim 4 further comprising a plurality of semi-cylindrical support members each protruding forwardly from said first wire yoke proximate a corresponding notch for supporting the corresponding wire extending therefrom.

8. A wire organizer for bundling a plurality of discrete insulated wires in a cabled configuration for mass insertion in a discrete-wire-terminating connector, said wires being stripped to expose a length of conductor, the wire organizer comprising:

a lower housing assembly, including, a lower shell section formed with a bottom wall and two side walls, a first wire yoke mounted across the bottom wall of said lower shell section, said wire yoke being formed with an array of notches spaced thereacross each for seating a corresponding one of said wires, and a pair of flanking teeth protruding into said notch for gripping the length of wire conductor on opposing sides, a second wire yoke arranged parallel behind said first wire yoke, said second wire yoke likewise being formed with an array of notches spaced thereacross each aligned with a notch on said first wire yoke for supplemental seating of said wire, and a pair of flanking teeth protruding into said notch for gripping the insulation of said wire on opposing sides; and an upper housing assembly to mate with said lower housing assembly and cover said first wire support bracket, thereby capturing said plurality of wires in their respective notches.

9. The wire organizer according to claim 8 wherein said upper housing assembly further comprises an upper shell section formed with an upper wall, and a first recess running across the upper wall of said upper shell section for receiving the first wire yoke of the lower housing assembly.

10. The wire organizer according to claim 9 wherein said upper wall of the upper shell section is formed with a second recess running crosswise behind said first recess for receiving the second wire yoke of the lower housing assembly.

11. The wire organizer according to claim 8 wherein said lower shell section is formed with a lower plate protruding forwardly of said first wire yoke, and said upper shell section further comprises an upper plate protruding forwardly in parallel with said upper plate, said upper and lower plates serving to shroud the wires protruding forwardly therebetween.

12. The wire organizer according to claim 11 wherein at least one of said lower plate and upper plate are keyed to said ballast connector.

13. The wire organizer according to claim 8 wherein said first wire yoke and first recess arrange said wires with the respective lengths of conductor protruding forwardly therefrom in a side-by-side array for mass insertion into a ballast connector.

14. The wire organizer according to claim 8 further comprising a pair of latches mounted on opposing sides of said lower housing for securing said wire organizer to said ballast connector.

15. The wire organizer according to claim 14 wherein said pair of latches each comprise a latching finger pivotable about a resilient central stem, said central stems being integrally formed to protruding outwardly from said side-walls, and said latching finger being formed with a forward latching tip for releasably locking said wire organizer against said ballast connector.

16. The wire organizer according to claim 8 further comprising a plurality of semi-cylindrical support members each protruding forwardly from said first wire yoke before a corresponding notch for supporting the corresponding wire extending therefrom.

* * * * *